US009006167B2

(12) United States Patent
Yianakopoulos et al.

(10) Patent No.: US 9,006,167 B2
(45) Date of Patent: Apr. 14, 2015

(54) CLEANING COMPOSITION

(75) Inventors: Georges Yianakopoulos, Liege (BE); Jacques Noiret, Aineffe (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 14/357,253

(22) PCT Filed: Nov. 18, 2011

(86) PCT No.: PCT/US2011/061396

§ 371 (c)(1),
(2), (4) Date: May 9, 2014

(87) PCT Pub. No.: WO2013/074118

PCT Pub. Date: May 23, 2013

(65) Prior Publication Data

US 2014/0315778 A1 Oct. 23, 2014

(51) Int. Cl.

| | |
|---|---|
| ***C11D 1/72*** | (2006.01) |
| ***C11D 1/825*** | (2006.01) |
| ***C11D 3/10*** | (2006.01) |
| ***C11D 3/22*** | (2006.01) |
| ***C11D 17/00*** | (2006.01) |

(52) U.S. Cl.
CPC *C11D 3/222* (2013.01); *C11D 1/72* (2013.01); *C11D 1/8255* (2013.01); *C11D 3/10* (2013.01); *C11D 17/003* (2013.01)

(58) Field of Classification Search
CPC ..... C11D 1/72; C11D 1/825; C11D 3/10; C11D 3/222
USPC ..... 510/356, 421, 435, 470, 509; 134/25.2, 134/25.3, 39, 42
See application file for complete search history.

(56) References Cited

U.S. PATENT DOCUMENTS

| | | | | |
|---|---|---|---|---|
| 5,877,142 | A | 3/1999 | Gross et al. | |
| 2004/0058839 | A1 | 3/2004 | Tadrowski | |
| 2004/0063796 | A1 | 4/2004 | Winston et al. | |
| 2004/0102346 | A1 * | 5/2004 | Carr et al. | 510/276 |
| 2006/0234890 | A1 | 10/2006 | Griese | |
| 2012/0102668 | A1 * | 5/2012 | De Leersnyder et al. | 15/104.93 |

FOREIGN PATENT DOCUMENTS

| | | |
|---|---|---|
| GB | 1357323 | 6/1974 |
| WO | WO 8303621 | 10/1983 |

OTHER PUBLICATIONS

International Search Report and the Written Opinion issued in International Application PCT/US2011/61396 mailed Jul. 17, 2012. WO.
Smolka et al., Charge screening effects on filament dynamics in xanthan gum solutions, J. Non-Newtonian Fluid Mech., 137 (2006); 103-109.
Written Opinion of the International Preliminary Examining Authority issued in International Application PCT/US2011/61396 mailed Oct. 22, 2013. WO.
Zatz et al., Viscosity of Xanthan Gum Solutions at Low Shear Rates, Journal of Pharmaceutical Sciences, 73 (1984) 468-471.

* cited by examiner

*Primary Examiner* — Brian P Murk
(74) *Attorney, Agent, or Firm* — Michael F. Morgan

(57) ABSTRACT

Provided is an aqueous cleaning composition comprising at least one surfactant, xanthan gum, and a carbonate salt, wherein the composition has a turbidity of less than 16 NTU. Also provided is a method of cleaning a substrate by applying the cleaning composition to the substrate.

33 Claims, No Drawings

CLEANING COMPOSITION

CROSS-REFERENCE TO RELATED PATENT APPLICATIONS

The present application is a U.S. national stage entry under 35 U.S.C. 371 of Patent Cooperation Treaty Patent Application No. PCT/US2011/61396, filed Nov. 18, 2011, the entirety of which is incorporated herein by reference.

FIELD OF THE INVENTION

The present invention relates to a cleaning composition that is thickened with xanthan gum and preserved with carbonate.

BACKGROUND OF THE INVENTION

Cleaning compositions can be designed to clean different surfaces. Because cleaning compositions typically contain surfactants, they need to be preserved from microbiological growth. Typically, an additional preservative is needed, and an additional cost is added to the composition. It would be desirable to have a material that is already present in the cleaning composition provide the microbiological protection. Also, cleaners may need to be thickened for their intended purpose for which a thickener can be added. Also, it may be desired to have a cleaner that is clear. When designing a cleaner to meet all of these needs, it may not be possible to obtain a clear composition that is thickened and self preserved. It would be desirable to develop this type of cleaning composition.

BRIEF SUMMARY OF THE INVENTION

Provided is an aqueous cleaning composition comprising at least one surfactant, xanthan gum, and a carbonate salt, wherein the composition has a turbidity of less than 16 NTU. Also provided is a method of cleaning a substrate by applying the cleaning composition to the substrate.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

DETAILED DESCRIPTION OF THE INVENTION

The following description of the preferred embodiment(s) is merely exemplary in nature and is in no way intended to limit the invention, its application, or uses.

The composition contains xanthan gum. The amount of xanthan gum can be any amount to provide a desired viscosity for a cleaning composition. In certain embodiments, the amount of xanthan gum is 0.1 to 1% by weight of the composition, optionally 0.1 to 0.9%, 0.1 to 0.8%, 0.1 to 0.7%, 0.1 to 0.6%, 0.3 to 0.7%, 0.4 to 0.6%, or 0.5% by weight of the composition.

The composition contains a carbonate salt. The carbonate salt can be any monovalent metal carbonate salt. Examples of the carbonate salt include, but are not limited to, sodium carbonate and potassium carbonate. In one embodiment, the carbonate is sodium carbonate. The carbonate salt can be present in an amount to provide an alkaline pH to the composition. This quantity of carbonate salt is sufficient to preserve the cleaning composition such that preservatives are not required. The carbonate salt can be present in an amount of 0.1 to 2.5% by weight of the composition, optionally 0.1 to 2%, 0.1 to 1.5%, 0.1 to 1.2%, 0.5 to 2.5%, 0.5 to 2%, 0.5 to 1.5%, 0.5 to 1.2%, 1 to 2.5%, 1 to 2%, 1 to 1.5%, or 1 to 1.2% by weight of the composition. The carbonate salt should also be present in an amount that provides the desired level of clarity to the composition.

The carbonate can increase the ionic strength of the composition without impairing the thickening ability of the xanthan gum.

The composition can be fragrance free. Even without fragrance, which can add a microbiocide effect, the composition can remain preserved with the carbonate.

The composition can be free of coloring agents. Also, while free of coloring agents, the composition can have no color associated with the composition, such as a yellow color. In certain embodiments, the composition has a Klett color of 0 to 20, optionally 0 to 10 or 0 to 5.

The cleaning compositions comprise one or more surfactants. For example, in certain embodiments, the compositions may comprise, at least one of a non-ionic, zwitterionic, or anionic surfactant; or a mixture of any of these foregoing. For example, zwitterionic surfactants (such as cocoamidopropyl betaine, lauryl/myristyl dimethyl betaine or cocoamidopropyl hydroxyl betaine) and non-ionic surfactants (such as alkoxylated alcohol non-ionic surfactants, e.g., polyethoxylated alcohol, or alkyl polyglucoside) may be useful for the present embodiments. In various embodiments, the compositions of the present invention comprise surfactant in an amount of 0.1 to 15%, 0.1 to 12%, 0.1 to 10%, 0.1 to 8%, 0.1 to 6%, 0.5 to 15%, 0.5 to 12%, 0.5 to 10%, 0.5 to 8%, 0.5 to 6%, 1 to 15%, 1 to 12%, 1 to 10%, 1 to 8%, 1 to 6%, or 4 to 6% by weight of the total composition.

In various embodiments, the composition comprises a non-ionic surfactant such as, e.g., a polyethoxylated alcohol. An example of an alkoxylated alcohol non-ionic surfactant that may be useful for the present invention includes a composition of Formula I:

$$CH_3(CH_2)_m—(O—CH_2—CH_2)_n—OH, \quad (I)$$

wherein m is 7 to 15; and n represents an average degree of ethoxylation for the mixture of 1 to 15. In various embodiments, the surfactants used are one or more mixtures comprising compounds of the above formula wherein n is 7 to 9 or 2 to 3. The polyethoxylated alcohol may be, for example, a mixture of compounds of Formula I wherein m is 8 to 10, and n represents an average degree of ethoxylation for the mixture of 1 to 15. In one embodiment, the non-ionic surfactant is a combination of C10 ethoxylated alcohols, and in one embodiment, a mixture of C10 ethoxylated alcohol with an average of 7 EO groups and C10 ethoxylated alcohol with an average of 3 EO groups.

In various embodiments, the non-ionic surfactant present in the compositions of the present invention may be aliphatic ethoxylated non-ionic surfactants, for example, those that are commercially well known and include the primary aliphatic alcohol ethoxylates and secondary aliphatic alcohol ethoxylates. The length of the polyethenoxy chain can be adjusted to achieve the desired balance between the hydrophobic and hydrophilic elements.

The nonionic surfactant class also may include the condensation products of a higher alcohol (e.g., an alkanol containing 8 to 16 carbon atoms in a straight or branched chain configuration) condensed with 2 to 20 moles of ethylene oxide, for example, lauryl or myristyl alcohol condensed with 16 moles of ethylene oxide (EO), tridecanol condensed with 6 to 15 moles of EO, myristyl alcohol condensed with 10 moles of EO per mole of myristyl alcohol, the condensation product of EO with a cut of coconut fatty alcohol containing a mixture of fatty alcohols with alkyl chains varying from 10 to 14 carbon atoms in length and wherein the condensate contains either 6 moles of EO per mole of total alcohol or 9 moles of EO per mole of alcohol and tallow alcohol ethoxylates containing 6 EO to 11 EO per mole of alcohol.

Illustrative examples of the foregoing non-ionic surfactants include, but are not limited to, the Neodol® or Dobanol® ethoxylates (Shell Co.), which are higher aliphatic, primary alcohol containing 9 to 15 carbon atoms, such as $C_9$-$C_{11}$ alkanol condensed with 4 to 10 moles of ethylene oxide (Neodol 91-8®, Dobanol 91-8®, Neodol 91-5®) or 2.5 moles of ethylene oxide (Neodol 91-2.5®), $C_{12}$-$C_{13}$ alkanol condensed with 6.5 moles ethylene oxide (Neodol 23-6.5®), $C_{12}$-$C_{15}$ alkanol condensed with 12 moles ethylene oxide (Neodol 25-12®), $C_{14}$-$C_{15}$ alkanol condensed with 13 moles ethylene oxide (Neodol 45-13®), and the like. Such ethoxamers have an HLB (hydrophobic lipophilic balance) value of 8 to 15 and give good O/W emulsification, whereas ethoxamers with HLB values below 7 contain less than 4 ethyleneoxide groups and tend to be poor emulsifiers and poor detergents. As used throughout the present disclosure, the trade names "Neodol" and "Dobanol" can be used interchangeably to refer to the same compounds, with the respective trade names used according to the geographies in which they are available.

Additional satisfactory water soluble alcohol ethylene oxide condensates include, but are not limited to, the condensation products of a secondary aliphatic alcohol containing 8 to 18 carbon atoms in a straight or branched chain configuration condensed with 5 to 30 moles of ethylene oxide. Examples of commercially available nonionic detergents of the foregoing type include $C_{11}$-$C_{15}$ secondary alkanol condensed with either 9 EO (Tergitol 15-S-9®) or 12 EO (Tergitol 15-S-12®) marketed by Union Carbide (USA).

In various embodiments, the compositions of the present invention may comprise one or more ionic surfactants. For example, the compositions of the present invention may comprise an anionic surfactant. The anionic surfactant may be any of the anionic surfactants known or previously used in the art of aqueous surfactant compositions. Suitable anionic surfactants include, but are not limited to, alkyl sulfates, alkyl ether sulfates, alkaryl sulfonates, alkyl succinates, alkyl sulfosuccinates, N-alkoyl sarcosinates, alkyl phosphates, alkyl ether phosphates, alkyl ether carboxylates, alkylamino acids, alkyl peptides, alkoyl taurates, carboxylic acids, acyl and alkyl glutamates, alkyl isethionates, and alpha-olefin sulfonates, especially their sodium, potassium, magnesium, ammonium and mono-, di- and triethanolamine salts. The alkyl groups generally contain 8 to 18 carbon atoms and may be unsaturated. The alkyl ether sulfates, alkyl ether phosphates and alkyl ether carboxylates may contain, in various embodiments, 1 to 10 or 1 to 3 ethylene oxide or propylene oxide units per molecule.

Examples of suitable anionic surfactants include sodium and ammonium lauryl ether sulfate (with 1, 2 or 3 moles of ethylene oxide), sodium, ammonium, and triethanolamine lauryl sulfate, disodium laureth sulfosuccinate, sodium cocoyl isethionate, sodium $C_{12}$-$C_{14}$ olefin sulfonate, sodium laureth-6 carboxylate, sodium $C_{12}$-$C_{15}$ pareth sulfate, sodium methyl cocoyl taurate, sodium dodecylbenzene sulfonate, sodium cocoyl sarcosinate, triethanolamine monolauryl phosphate, and fatty acid soaps.

Zwitterionic surfactants may also be used. Such surfactants contain both a cationic group and an anionic group. Preferred zwitterionic surfactants contain both a quaternary ammonium group and an anionic group selected from sulfonate and carboxylate groups. These anionic groups are desirable as they tend to maintain their amphoteric character over most of the pH range of the formulation. In certain embodiments, the zwitterionic surfactant used is cocamidopropyl betaine.

The compositions of the present invention may additionally include an organic solvent, e.g., a lower alkanol, a glycol ether or diether such as, for example, ethanol, propylene glycol, ethylene glycol, dipropylene glycol n-butyl ether, propylene glycol n-butyl ether or a phenoxyalkanol such as, for example, phenoxyethanol, phenoxyisopropanol; or mixtures or any of the above-described organic solvents. For example, in certain embodiments, the compositions of the present invention may include at least one ingredient chosen from ethanol, propylene glycol n-butyl ether or dipropylene glycol monobutyl ether. When present in various embodiments, the organic solvent may be present in an amount of 0.1 to 10%, 1 to 10%, 2 to 8%, 3 to 6%, 3.5 to 5.5% or 5% by weight of the composition. In certain embodiments, the compositions of the present invention comprise ethanol at 0.5 to 3%, or 0.5 to 2%, 0.5 to 1.5%, or 1% by weight of the composition.

The compositions of the present invention may also include one or more solubilizing agents, such as, for example, hexylene glycol, pentaethylene glycol hexyl ether, triethylene glycol hexyl ether, sodium chloride and/or sodium cumene sulfonate or sodium xylene sulfonate in an amount of 0.1 to 5% by weight. In certain embodiments, the compositions of the present invention may comprise sodium cumene sulfonate in an amount of 0.1 to 3%, 0.4 to 2%, 0.6 to 1.5%, 0.8 to 1.5%, or 0.9 to 1.1% by weight of the composition.

In certain embodiments, the composition may further comprise iminodisuccinate-sodium salt in an amount of 0.05% to 1.5%, 0.05% to 1%, 0.05% to 0.5%, 0.1% to 0.25%, or 0.22% by weight of the composition.

In certain embodiments, the composition further comprises a fatty acid salt. In certain embodiments, the amount is 0.1 to 1%, 0.1 to 0.5%, 0.1 to 3%, or 0.2 to 0.3% by weight of the composition. The fatty acid salt can be an alkali (monovalent) metallic ion salt. In one embodiment, the fatty acid salt is a salt of coconut oil fatty acid.

The composition contains water. The amount of water can be any desired amount to provide for a desired cleaning composition. In certain embodiments, the amount of water is 50 to 95% by weight of the composition.

The cleaning composition has an alkaline pH. In certain embodiments, the pH is 8 to 13, or optionally 9 to 12, 9 to 11, or 10 to 11.

The composition can have a viscosity of 200 to 1000 mPas, optionally 200 to 600, 300 to 600, 400 to 600, or 500 mPas. In this description and in the claims, viscosity is measured on RVT type viscometer with the spindle N° 2 at 50 rpm at 25° C.

In this description and in the claims, turbidity is measured using a HACH Model 2100P turbidimeter on samples at room temperature (23-25° C.). The composition has a turbidity of less than 16 NTU units. In other embodiments, the turbidity is less than 15, 14, 13, 12, 11, 10, 9, 8, 7, 6, 5, or 4 NTU units. These values translate to a clear composition.

In certain embodiments, the values for turbidity, pH, color, and viscosity can remain stable over time. In certain embodiments, the values for these can be within 10%, 5%, or 2% of the value that is measured initially after the composition is formed after 4 or 8 weeks at room temperature, after 4 or 8 weeks at 4° C., or after 4 or 8 weeks at 40° C.

The cleaning composition can be in any form, such as a hard surface cleaner, a bucket dilutable cleaner, or a spray.

EXAMPLES

The following are non-limiting examples of the invention. The compositions are made by mixing the ingredients.

| Material | Inventive | | | | Comparative | | | |
|---|---|---|---|---|---|---|---|---|
| Material (weight % as supplied) | 1 | 2 | 3 | 4 | A | B | C | D |
| Xanthan Gum | 0.5 | 0.5 | 0.5 | 0.55 | 0.5 | 0.5 | 0 | 0 |
| Carboxymethyl cellulose | 0 | 0 | 0 | 0 | 0 | 0 | 0.5 | 0 |
| Carrageenan polysaccharide | 0 | 0 | 0 | 0 | 0 | 0 | 0 | 0.5 |
| Sodium Carbonate | 1.2 | 2 | 2.36 | 1.08 | 3.56 | 5.2 | 1.2 | 1.2 |
| C10 ethoxylated alcohol-7EO | 4.1 | 4.1 | 4.1 | 4.1 | 4.1 | 4.1 | 4.1 | 4.1 |
| C10 ethoxylated alcohol-3EO | 1.65 | 1.65 | 1.65 | 1.65 | 1.65 | 1.65 | 1.65 | 1.65 |
| Coconut oil fatty acid | 0.25 | 0.25 | 0.25 | 0.25 | 0.25 | 0.25 | 0.25 | 0.25 |
| Ethanol (SD3A) | 1 | 1 | 1 | 1 | 1 | 1 | 1 | 1 |
| Sodium cumene sulfonate (40% active) | 2.6 | 2.6 | 2.6 | 2.6 | 2.6 | 2.6 | 2.6 | 2.6 |
| Iminodisuccinate acid sodium salt | 0.22 | 0.22 | 0.22 | 0.22 | 0.22 | 0.22 | 0.22 | 0.22 |
| Water and minors | q.s. | q.s. | q.s. | q.s. | q.s. | q.s. | q.s. | q.s. |
| Turbidity (NTU) | 10.47 | 13.43 | 15.1 | 9.83 | 29 | 91.67 | 40.13 | 487.67 |

| | pH | Viscosity (mPas) |
|---|---|---|
| Inventive Composition 1 | | |
| Initial | 10.2 | 480 |
| After 4 weeks | | |
| 4° C. | 10.2 | 500 |
| 25° C. at 60% relative humidity | 10.2 | 484 |
| 40° C. at 75% relative humidity | 10.2 | 494 |
| After 8 weeks | | |
| 4° C. | 10.1 | 460 |
| 25° C. at 60% relative humidity | 10.1 | 462 |
| 40° C. at 75% relative humidity | 10.1 | 480 |
| Inventive Composition 4 | | |
| Initial | 10.24 | 480 |
| After 4 weeks | | |
| 4° C. | 10.26 | 526 |
| 25° C. at 60% relative humidity | 10.25 | 528 |
| 40° C. at 75% relative humidity | 10.25 | 552 |

The examples above show that when used as the same amount, xanthan gum provides for a low turbidity, which is not visually perceivable composition; whereas, carboxymethyl cellulose or carrageenan polysaccharide produces a very turbid composition. The selection of xanthan gum allows for a clear solution to be obtained. Also, the composition can remain stable over time as evidenced by the pH and viscosity maintaining values close to the initial values.

Formula 1 is also compared to a formula with the xanthan gum removed. To 100 ml of each material, 0.27 g of dust is added and shaken three times. For Formula 1, the dust agglomerates and sinks to the bottom of the container. For the comparative formula, the dust remains dispersed in the composition. The test is repeated with the compositions being diluted (16 g of composition in 1 liter of water). The test also shows the same results.

The same neat and diluted Formula 1 and the comparative are used in simulated cleaning. 5 g of dust is uniformly spread onto a clean surface. A 15 cm×15 cm mop fabric is wetted with the cleaning compositions and used to clean the surface. The fabric is rinsed with clean tap water and squeezed. The rinsed fabric is used to wipe the surface again. The fabric is then rinsed and squeezed. Both the neat and dilute compositions show the same results. The fabric that is used with Formulation 1 is cleaner (has less soil on the fabric) than the comparative composition. While not being limited to theory, it is theorized that xanthan gum is slightly ionized to render the composition more hydrophilic, which excludes dust particles, which are hydrophobic. The dust forms agglomerates that cluster and form precipitates.

The formula is micro robust. Two micro tests are conducted on Formula 1. Micro Robustness Test (MRT) measures the micro robustness against bacteria of the composition during the production stage. A composition is considered robust if the Micro Robustness Index (MRI)>=0.85. Antimicrobial Preservation Efficacy Test (APET) measures the long term micro robustness against bacteria, mold & yeast and mimicking the usage of the product at home.

Formula 1 is tested and the results of the MRI and APET are provided below. Also, Formula 4 is tested.

| MRT of Formula 1 | APET of Formula 1 |
|---|---|
| Pass<br>MRI = 1.33 with AUC STD = 100 | OK: Pass criteria |
| **MRT of Formula 4** | **APET of Formula 4** |
| Pass<br>MRI = 1.12 with AUC STD = 100 | OK: Pass criteria |

As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

Unless otherwise specified, all percentages and amounts expressed herein and elsewhere in the specification should be understood to refer to percentages by weight. The amounts given are based on the active weight of the material.

What is claimed is:

1. An aqueous cleaning composition comprising at least one surfactant, xanthan gum, iminodisuccinate sodium salt, and a carbonate salt, wherein the carbonate salt is present in an amount of 0.1 to 1.5% by weight of the composition, and wherein the composition has a turbidity of less than 11 NTU.

2. The aqueous cleaning composition of claim 1, wherein the composition has an alkaline pH.

3. The aqueous cleaning composition of claim 1, wherein the xanthan gum is present in an amount of 0.1 to 1% by weight of the composition.

4. The aqueous cleaning composition of claim 1, wherein the carbonate salt is present in an amount of 0.1 to 1.2% by weight of the composition.

5. The aqueous cleaning composition of claim 1, wherein the surfactant is present in an amount of 0.1 to 15% by weight of the composition.

6. The aqueous cleaning composition of claim 1, wherein the carbonate salt is selected from the group consisting of monovalent metal carbonate salt, sodium carbonate and potassium carbonate.

7. The aqueous cleaning composition of claim 1, wherein the composition has a turbidity of less than 10 NTU.

8. The aqueous cleaning composition of claim 1, wherein the composition has a pH of 8 to 13.

9. The aqueous cleaning composition of claim 1, wherein the composition has a viscosity of 200 to 1000 mPas.

10. The aqueous cleaning composition of claim 1, wherein the composition has a Klett color of 0 to 20.

11. The aqueous cleaning composition of claim 1 further comprising a solubilizing agent.

12. The aqueous cleaning composition of claim 1 further comprising a solvent.

13. An aqueous cleaning composition comprising at least one surfactant, xanthan gum, fatty acid salt, and a carbonate salt, wherein the carbonate salt is present in an amount of 0.1 to 1.5% by weight of the composition, and wherein the composition has a turbidity of less than 11 NTU.

14. The aqueous cleaning composition of claim 1, wherein the surfactant comprises a non-ionic surfactant.

15. The aqueous cleaning composition of claim 1, wherein the surfactant comprises at least two ethoxylated alcohol surfactants.

16. The aqueous cleaning composition of claim 1, wherein the composition is free of coloring agents.

17. The aqueous cleaning composition of claim 1, wherein the composition is free of fragrance.

18. An aqueous cleaning composition comprising:

a. 4 to 6% by weight of a non-ionic surfactant;

b. 0.1 to 1% by weight of xanthan gum, c. 1 to 2.5% by weight sodium carbonate, d. 0.5 to 1.5% solubilizing agent, e. 0.5 to 3% solvent, f. 0.1 to 0.5% fatty acid salt, and g. 0.05 to 0.5% iminodisuccinate-sodium salt, wherein the composition has a turbidity of less than 16 NTU.

19. A method of cleaning a substrate comprising applying the cleaning composition of claim 1 to the substrate.

20. The aqueous cleaning composition of claim 11, wherein the solubilizing agent is present in an amount of 0.1 to 3% by weight of the composition.

21. An aqueous cleaning composition comprising at least one surfactant, xanthan gum, sodium cumene sulfonate, and a carbonate salt, wherein the carbonate salt is present in an amount of 0.1 to 1.5% by weight of the composition, and wherein the composition has a turbidity of less than 11 NTU.

22. The aqueous cleaning composition of claim 1, wherein the iminodisuccinate-sodium salt is present in an amount of 0.05 to 1.5% by weight of the composition.

23. An aqueous cleaning composition comprising at least one surfactant, xanthan gum, ethanol, and a carbonate salt, wherein the carbonate salt is present in an amount of 0.1 to 1.5% by weight of the composition, and wherein the composition has a turbidity of less than 11 NTU.

24. The aqueous cleaning composition of claim 23, wherein the ethanol is present in an amount of 0.1 to 10% by weight of the composition.

25. The aqueous cleaning composition of claim 13, wherein the fatty acid salt is present in an amount of 0.1 to 1% by weight of the composition.

26. The aqueous cleaning composition of claim 13, wherein the fatty acid salt is a salt of coconut oil fatty acid.

27. The aqueous cleaning composition of claim 15, wherein the at least two ethoxylated alcohol surfactants comprise a C10 ethoxylated alcohol with an average of 7 EO groups and a C10 ethoxylated alcohol with an average of 3 EO groups.

28. The aqueous cleaning composition of claim 18, wherein the nonionic surfactant comprises a C10 ethoxylated alcohol with an average of 7 EO groups and a C10 ethoxylated alcohol with an average of 3 EO groups.

29. The aqueous cleaning composition of claim 18, wherein the solubilizing agent is sodium cumene sulfonate.

30. The aqueous cleaning composition of claim 18, wherein the solvent is ethanol.

31. The aqueous cleaning composition of claim 18, wherein the composition has a viscosity of 400 to 600 mPas.

32. The aqueous cleaning composition of claim 18, wherein the composition has a pH of 9 to 11.

33. The aqueous cleaning composition of claim 18, wherein the composition has a Klett color of 0 to 20.

* * * * *